United States Patent [19]

Jons

[11] Patent Number: 5,009,054

[45] Date of Patent: Apr. 23, 1991

[54] METHOD OF STORING THREAD IN AN EMBROIDERY THREAD-HOLDER

[75] Inventor: Roena B. Jons, Kerrville, Tex.

[73] Assignee: Anthony E. Braun, Kerrville, Tex. ; a part interest

[21] Appl. No.: 405,149

[22] Filed: Sep. 8, 1989

[51] Int. Cl.[5] ..... B65B 27/06; B65B 27/12; B65B 67/00; B65B 15/04

[52] U.S. Cl. ..... 53/397; 53/435; 53/474; 53/475

[58] Field of Search ..... 53/564, 397, 399, 409, 53/585, 591, 390, 566, 582, 255, 435, 474, 475

[56] References Cited

U.S. PATENT DOCUMENTS

| | | | |
|---|---|---|---|
| Re. 16,283 | 3/1926 | Mitchell | 53/255 X |
| 2,720,055 | 10/1955 | Morris | 53/255 X |
| 3,619,966 | 11/1971 | Goldsberrry | 53/564 X |
| 4,319,703 | 3/1982 | Gann | 206/388 X |
| 4,380,296 | 4/1983 | Murray et al. | 206/388 X |

*Primary Examiner*—Horace M. Culver
*Attorney, Agent, or Firm*—Cox & Smith

[57] ABSTRACT

A portable storage unit with multiple linear pockets to carry a large assortment of embroidery floss of different variety and color, and a means to facilitate storage of embroidery floss into the pockets using a special tool.

3 Claims, 1 Drawing Sheet

METHOD OF STORING THREAD IN AN EMBROIDERY THREAD-HOLDER

BACKGROUND OF THE INVENTION

This invention relates generally to storage holders for needlecraft thread and the like and, more particularly, but not by way of limitation, to an embroidery thread-holder with multiple compartments capable of visible storage of a wide selection of threads. Conventional needlecraft involves the use of multiple colors and different varieties of thread. Enthusiasts of needlecraft often encounter difficulty keeping track of the multiple colors and varieties of thread which get tangled and disorganized if kept in close proximity to each other. This invention solves the messy problems of disorganization.

Needlecraft necessarily involves the use of multiple variations in thread, and keeping different threads in close proximity is a necessary evil since the activity usually cannot be performed using a single color or texture. Thus, organization of different threads is a problem in conventional needlecraft such as embroidery. One could organize different threads on spools and the like in a given defined area, but this drastically limits the work location at which the needlecraft enthusiast can work. If an alternate workstation is desired, as it is common for needlecraft enthusiasts to move around to different locations periodically, the entire organization of thread has to be relocated.

Needlecraft, such as embroidery, is predominantly a hobby for enthusiasts who like to enjoy the hobby in different locations and not necessarily confined to one limited area. There is a need for a portable storage unit that can easily store multiple assortments of different thread without the detriment of tangled disorganization. This invention negates the need to move multiple spools and bundles of thread every time the embroidery enthusiast changes location and, further, facilitates the taking of the hobby along on trips, vacations and the like without having to move the entire workstation and supply of threads.

There is a need for a portable storage unit with multiple compartments to easily transport multiple varieties of thread. This unit also has to permit easy and facilitated access to the threads once they are organized. The unit has to be able to organize the varieties of thread such that tangled masses of confusion do not occur with the multiple thread varieties in close proximity to each other. All of these needed features are encompassed in the present invention that is disclosed herein.

SUMMARY OF THE INVENTION

The present invention overcomes the hindrances encountered in conventional needlecraft mentioned above by providing a novel apparatus which is easily transportable and, further, provides easy and facilitated access to multiple storage compartments containing a large variety of threads.

The present invention is basically comprised of two layers of flexible planar material which are affixed to each other via linear striations at given intervals. The affixed connections form pockets therebetween, creating storage compartments.

The materials that can be used as planar layers are limitless, ranging from synthetic plastics like polyvinyls, to natural fiber or leather materials, or any flexible material available in thin sheet form. The preferred embodiment is made from clear, transparent polyvinyl sheets. The first layer is a bottom planar layer over which is superimposed and affixed another planar layer. The two layers are fused at striated linear points by heat-fixing means.

In the preferred embodiment, the parallel striations form heat-fused lines between which pockets are formed. The linear pockets are open at both ends, providing easy access at either end. The multiple linear pockets are used to store a wide variety of thread or embroidery floss in each separate pocket. The separations between each linear pocket provided by the heat-fused lines create distinct spaces that prevent tangles between two adjacent thread bundles. Additionally, the transparent polyvinyl layers provide a clear, "see-through" canopy, allowing the embroidery enthusiast to visually select desired floss as is needed for any particular project.

As the above demonstrates, the portable storage unit of the present invention is very easily manufactured from a wide selection of conventionally available materials. Two planar layers of relevant material are affixed by conventional means available to those skilled in the art. All that is necessary is the formation of linear pockets parallel to each other so that separate, distinct and hollow compartments are formed for use as storage areas for thread or embroidery floss.

Additionally, a special elongated tool is provided as part of this invention which facilitates storage of thread into the portable unit. The tool basically comprises a thin, elongated shaft with a ring at a first end and a hook at a second end. The specialized tool is used to insert bundles of thread into the pockets of the portable storage unit.

Embroidery floss is available on the market in circular thread bundles. These threads are coiled into 12-inch long, linear bundles, then folded in half to form another linear thread bundle about 6 inches in length. These 6-inch linear bundles are then wrapped with strips of paper around the midsections for commercial distribution. Ordinarily, a needlecraft enthusiast breaks the paper wrapping and unfolds the floss into the 16 to 18 inch linear coils. Without the present invention, this is where the problems of tangle and disorganization arise.

Normally, embroidery projects require approximately 16 to 18 inch lengths of thread at a time. When the embroidery enthusiast begins cutting threads of different color, a messy tangle of loose threads results. With the special tool provided, the embroidery enthusiast avoids this problem by simply hooking a 16 to 18 inch coil of a particularly colored thread and hoisting it into its individual pocket located in the storage unit.

The hook end of the special tool is initially inserted into a linear pocket compartment at a first end of the pocket until the hook protrudes from the other end of the pocket. A desired 16 to 18 inch coil of thread is hooked and hoisted into the linear pocket until the hook again re-emerges at the first end. The hook is then removed from the thread coil, leaving behind a bundle of thread within the pocket with some of the thread protruding from both ends of the pocket in semi-circular loops. The embroidery enthusiast then cuts each semi-circular loop, which leaves 16 to 18 inch long threads within the pocket, allowing easy retrieval in lengths perfect for embroidery.

An ordinary knitting needle could feasibly be substituted for the special tool, but the hook on an ordinary knitting needle is too blunt and small to hoist an embroidery floss bundle into the storage unit. Thus, the special tool is essential for utilizing the benefits of the portable storage unit because it enhances the ease of initial storage of commercially available thread.

Other objects, features and advantages of the invention will become evident in light of the following detailed description considered in conjunction with the referenced drawing of a preferred exemplary embodiment according to the present invention.

DETAILED DESCRIPTION OF THE PREFERRED EMBODIMENT

Figure 1:
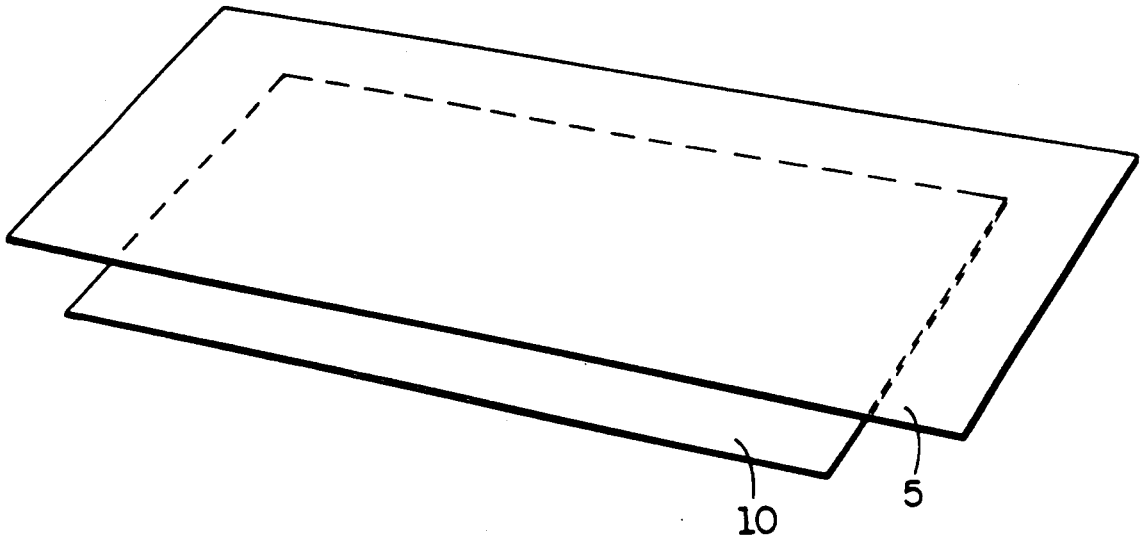
FIG. 1 is a perspective view of two planar sheets immediately prior to affixation to each other.
Figure 2:
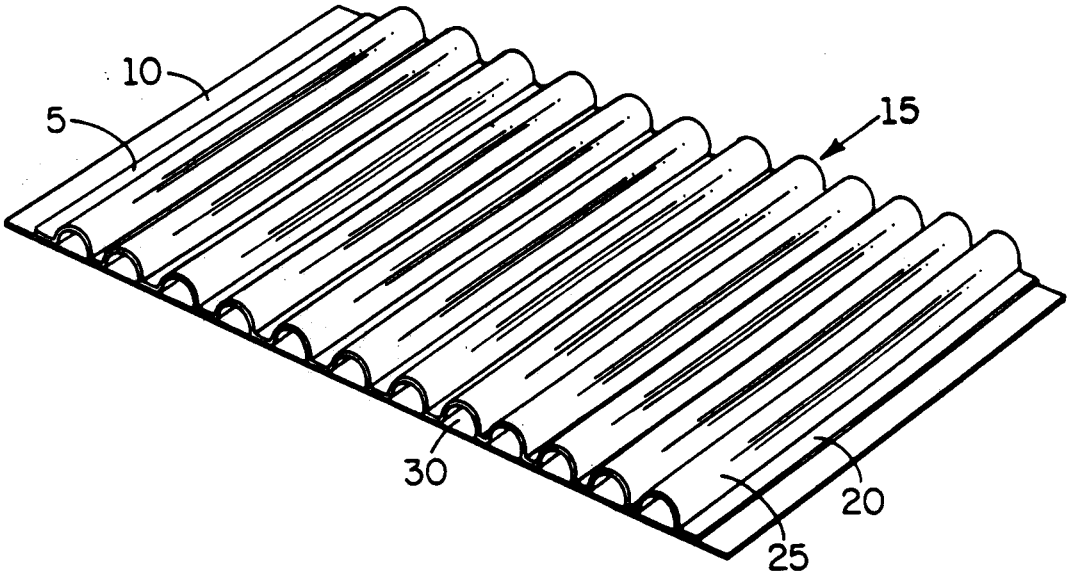
FIG. 2 is the above-mentioned two layers affixed to each other to form parallel linear compartments.

FIG. 1 shows two planar sheets of ordinary clear plastic, such as polyvinly, which comprise the starting blocks of the preferred embodiment of the present invention. Upper layer 5 is affixed onto lower layer 10 with a high-temperature heating means along elongated strips. In FIG. 2, these linear affixations are depicted by line 20.

The linear heat-fused strips are repeated along the entire length of the bottom layer 10 at periodic intervals. Parallel pockets are thereby formed; one such pocket is depicted in FIG. 2, numeral 25. The pockets are also formed along the entire length of the lower layer 10 at periodic, parallel intervals. The top layer 5 is divided at linear strips 20 to form the cavity pockets 25.

Figure 3:
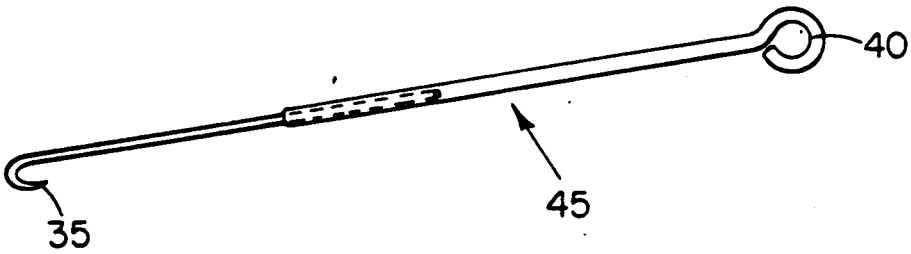
FIG. 3 is an elongated, solid-shaft tool that is used in conjunction with the present invention.

FIG. 3 depicts an elongated tool which is used in conjunction with the invention. The tool is comprised of a slender elongated shaft 45, a hook 35 at one end, and a circular holding stem 40 at the other end. In the preferred embodiment, the hook end 35 is inserted into a pocket at a first end. This first end is designated in FIG. 2 by numeral 15. The tool is inserted into the length of the pocket until the hook appears at the distal end 30. At this point, a coiled bundle of embroidery floss is attached to the hook and the bundle is pulled back into the pocket. Once the hook re-emerges at end 15, the thread bundle is disengaged from the hook, leaving semi-circular loops of thread at ends 15 and 30.

An ordinary pair of scissors is used to cut the semi-circular loops, leaving within individual pockets floss in lengths suitable for embroidery. This process is repeated until all other desired pockets 25 are full. The entire storage unit is now ready to be used or transported to a different location to be used there.

Although the invention has been described in conjunction with the foregoing specific embodiment, many alternatives, variations and modifications will be apparent to those of ordinary skill in the art. Those alternatives, variations and modifications are intended to fall within the spirit and scope of the appended claims.

What is claimed is:

1. A method for storage and retrieval of thread for an embroidery thread-holder, which comprises:

placing an elongated tool at a distal end of a cylindrical compartment of said embroidery thread holder;

protruding a hook of said elongated tool through said cylindrical compartment and from a proximate end of said cylindrical compartment;

attaching a coiled bundle of thread to said hook at said proximate end of said cylindrical compartment; and retracing said coiled bundle of thread to said hook at said proximate end of said cylindrical compartment such that semi-circular tips of said bundle of thread remain protruding from said proximate end and said distal end of said cylindrical compartment;

cutting said semi-cilcular tips of said bundles of thread protruding from said proximate and distal ends of said cylindrical compartments to allow retrieval of said thread in lengths used for embroidery.

2. The method as in claim 1 wherein said elongated tool comprises:

a hook at a first end;

a circular holding portion at a second end; and an elongated shaft connecting said first and second ends.

3. The method as in claim 1 wherein said embroidery thread-holder comprises:

a first planar flexible layer; and a second planar flexible layer attached onto said first planar flexible layer along a plurality of elongated strips such that a plurality of cylindrical compartments form between said elongated strips.

* * * * *